United States Patent [19]

Nikolayuk

[11] 4,297,706

[45] Oct. 27, 1981

[54] CIRCULARLY POLARIZED SLOTTED PYLON ANTENNA

[75] Inventor: Nicholas Nikolayuk, Gibbsboro, N.J.

[73] Assignee: RCA Corporation, New York, N.Y.

[21] Appl. No.: 131,273

[22] Filed: Mar. 17, 1980

[51] Int. Cl.[3] ..... H01Q 13/12

[52] U.S. Cl. ..... 343/771

[58] Field of Search ..... 343/767, 770, 771

[56] References Cited

U.S. PATENT DOCUMENTS

| | | | |
|---|---|---|---|
| 2,635,188 | 4/1953 | Riblet | 343/771 |
| 2,658,143 | 11/1953 | Fiet et al. | 343/770 |
| 2,679,590 | 5/1954 | Riblet | 343/771 |
| 2,744,249 | 5/1956 | Shiveley et al. | 343/853 |
| 2,756,421 | 7/1956 | Harvey et al. | 343/770 |
| 3,328,800 | 6/1967 | Algeo | 343/771 |
| 4,197,549 | 4/1980 | Collins | 343/771 |

*Primary Examiner*—Eli Lieberman

*Attorney, Agent, or Firm*—Paul J. Rasmussen; William H. Meise; Henry I. Steckler

[57] ABSTRACT

A circularly polarized antenna uses at least one pair of slots disposed at right angles to each other and cut into a vertical conducting mast to radiate the signal. The slots are vertically spaced about one half of a wavelength from each other to eliminate end fire radiation along the axis of the mast.

11 Claims, 8 Drawing Figures

REL. AMPLITUDE
$A_n$
RELATIVE PHASE
$\phi_n$
+
-
$\phi$
12
10
14
18
26
28
42
42a
48
48a
72
74

CIRCULARLY POLARIZED SLOTTED PYLON ANTENNA

BACKGROUND OF THE INVENTION

The present invention relates to circularly polarized antennas, and more particularly, to such antennas that are used in television broadcasting.

Recently there has been much interest in using circular polarization for television broadcasting to improve reception and reduce ghosts in the displayed picture. To achieve this, various structures have been used, such as loops, dipoles, or coils, supported by a central vertical mast. However, such radiators increase the wind loading over what would be present with just the mast and also cause icing problems. One way to overcome these problems is to use as radiators slots that are cut into the mast. In order to achieve circular polarization, at least one pair of slots must be used which are spatially oriented 90° with respect to each other and which are fed with equal amplitude signals that are 90° in time phase with respect to each other. One way of achieving this is shown in U.S. Pat. No. 2,756,421, which shows pairs of slots, wherein the slots of any one pair are at right angles with respect to each other and have a vertical center to center spacing of a quarter of a wavelength of the excitation wave within the mast in order to achieve the 90° time phasing. However, it has been found that the vertical component radiated by such an antenna will end fire radiate in a direction other than the desirable horizontal direction. Further, certain antennas have undesirable nulls in the elevation pattern and have beam tilt change and a poor impedance characteristic across a channel.

It is therefore desirable to have a circularly polarized antenna that has low windloading, a minimum of icing problems, does not radiate substantial energy in an end fire, have undesirable nulls, or have beam tilt change or a poor impedance characteristic across a channel.

SUMMARY OF THE INVENTION

In brief, this is achieved by having an antenna comprising a conducting vertical cylinder having a plurality of slots, said slots being disposed in a plurality of vertically stacked bays, each bay comprising at least one pair of slots disposed at about right angles to each other, slots of each pair being spaced with respect to each other by about one-half of a wavelength of a desired center frequency between horizontal centers of said slots, and means for exciting said slots so that slots comprising a pair are in about 90° time phase relationship and have equal amplitudes with respect to each other. Traveling wave excitation with a phase step between upper and lower halves of the antenna is used to provide an improved impedance characteristic, an elevation pattern without undesirable nulls, and stability across the channel of the elevation pattern, particularly as to beam tilt.

DETAILED DESCRIPTION

Figure 1:
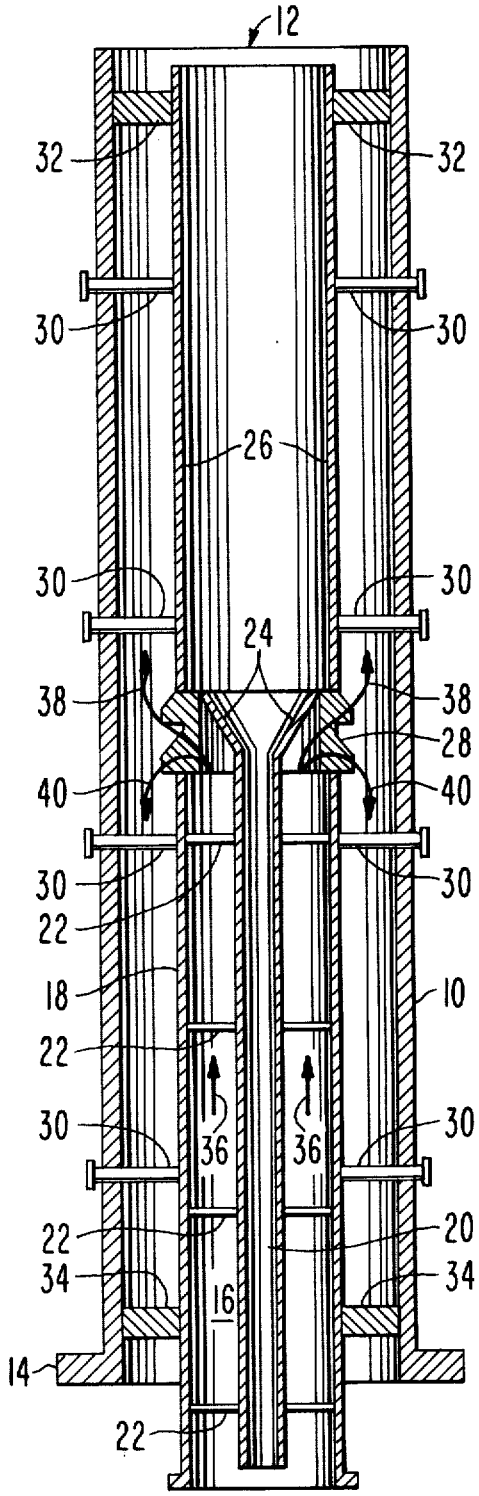
FIG. 1 shows a cross sectional elevation view of the antenna.

FIG. 1 shows a cross section of the antenna which generally comprises a vertical conducting hollow cylindrical mast 10 having an open top 12 and at the bottom a mounting flange 14. Entering through the flange 14 is a coaxial feed line or harness 16 comprising an outer conductor 18 and an inner conductor 20. Insulating discs 22 keep the inner conductor 20 centered within outer conductor 18. Thus, the feed line 16 is mainly air insulated, although for high power other gases, such as nitrogen or freon, can be used. The feed line inner conductor 20 has a conical shape portion 24 that is electrically connected to an upper half of an antenna inner conductor 26. The outer conductor 18 of the feed line serves as the lower half of the antenna inner conductor. The upper and lower inner conductors 26 and 18 are separated from each other by an insulating end gas seal 28, which can be made of Teflon. Insulating centering pins 30 keep the upper and lower inner conductors 26 and 18 centered within the mast 10, which serves as an outer conductor, thereby forming a coaxial transmission line with the inner conductors 18 and 26. This antenna transmission line will have a characteristic impedance. Near the top of the mast 10 is a plurality of spokes 32 that short circuit the outer conductor mast 10 to the top of the upper inner conductor 26. Similarly near the bottom of mast 10, there are plurality of spokes 34 that short circuit the mast 10 to the bottom of the lower inner conductor 18.

In operation a TEM wave is excited within the line 16 by the transmitter (not shown) and propagates in the direction indicated by arrows 36. The wave propagates up to the insulator 28 and divides into two waves as it goes through it, half going up as indicated by arrows 38 and half going down as indicated by arrows 40. In propagating between the antenna inner conductors 18 and 26 and the antenna outer conductor 10, i.e. in the antenna transmission line, the wave is a TEM one and excites slots disposed in mast 10 (not shown in FIG. 1) to radiate the desired pattern as will be more fully explained below.

Figure 2:
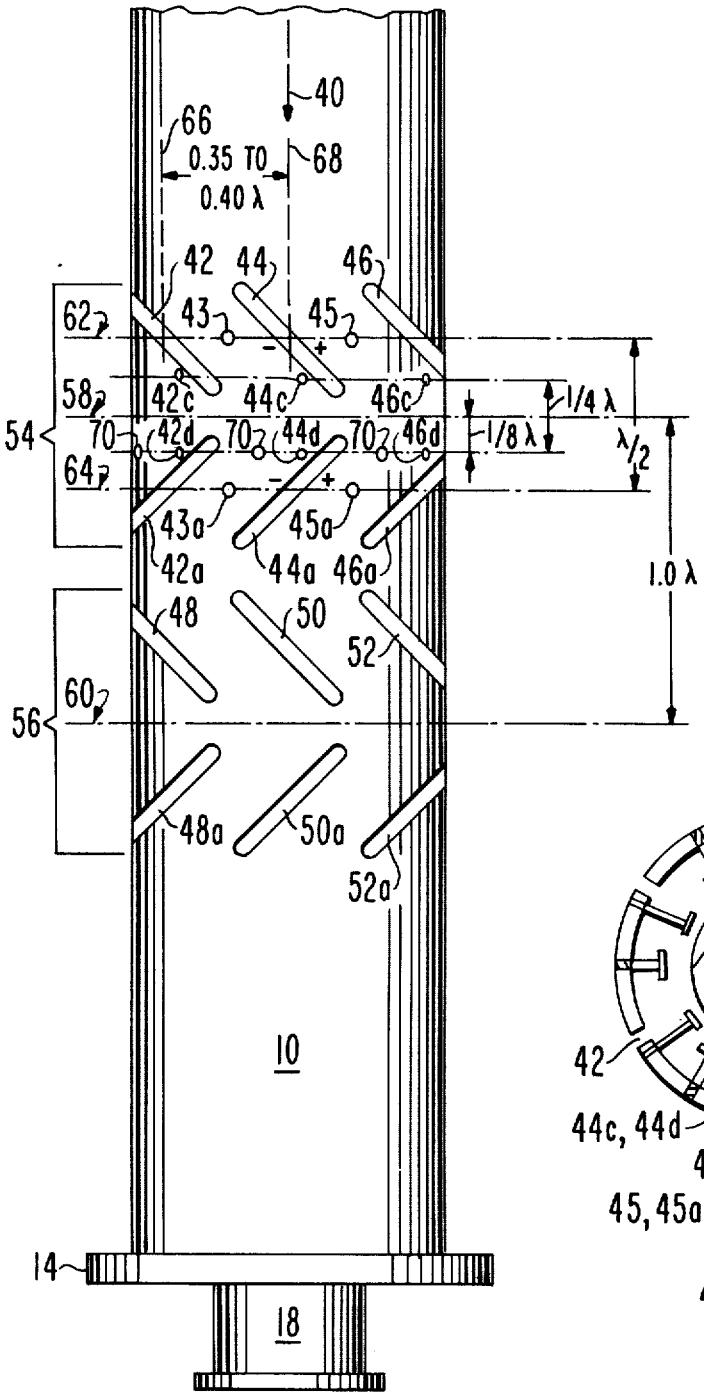
FIG. 2 shows the disposition of the radiating slots of the antenna.
Figure 3:
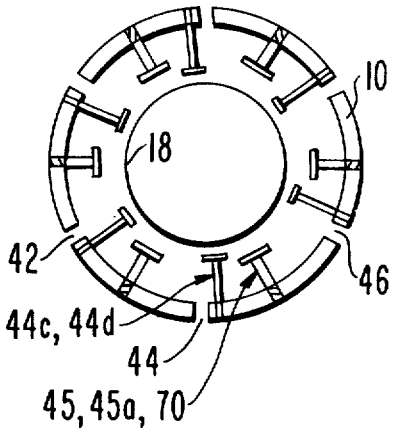
FIG. 3 shows a top view of various probes used in the antenna.

FIG. 2 shows the lower half of the mast 10, the upper half being symmetrical with the lower half with respect to the slot placement. As will be seen, two bays of slots 54 and 56 are shown, although in a practical embodiment, more than two bays are normally used as is required to achieve a desired power gain. The bays 54 and 56 are spaced one wavelength apart as measured by horizontal center lines 58 and 60 located between the slots making up the individual bays. This spacing minimizes minor lobes. Bay 54 comprises slots 42, **42*a*, 44, 44*a*, 46, 46*a*, while bay 56 comprises slots 48, 48*a*, 50, 50*a*, 52, 52*a*. Only three pairs of slots are shown for each bay in FIG. 2, although in the particular embodiment shown in FIG. 2 there are actually six pairs of slots in each bay, the remaining slots being hidden by mast 10. All slots which are designated without using the suffix "a" are disposed at an angle of minus 45° with respect to the longitudinal axis of mast 10, while all slots designated with the suffix "a" are at an angle of plus 45° with respect to the same axis. Thus slots having the same number, with or without the suffix "a", form a pair disposed at right angles to each other to give the required spatial relationship to generate circular polarization. In accordance with the present invention, slots making up a pair are spaced by one half of a wavelength between their horizontal center lines 62 and 64. As explained below, this eliminates end fire radiation. Horizontally adjacent slots are spaced from about 0.35 to 0.40 of a wavelength between their vertical center lines 66 and 68. This spacing is uniform around the circumference of mast 10 to give an omnidirectional pattern. The number of slots required and their horizontal spacing is determined by the diameter of mast 10 so as to give an omnidirectional or directional pattern as desired. Reference now will be made to just the slot pair 44, 44***a*, it being understood that all pairs are identical except as described below. Probes 44*c* and 44*d* are placed adjacent to slots 44 and 44*a* respectively. These probes are each an eighth of a wavelength spaced from center line 58, and thus are a quarter wavelength spaced from each other. As shown in FIG. 3, the probes 44 horizontally extend into the space between the inner conductor 18 and mast outer conductor 10. Corresponding sides of slots 44 and 44*a* have been marked with "+" on the right sides and "−" on the left sides.

Figure 4A:
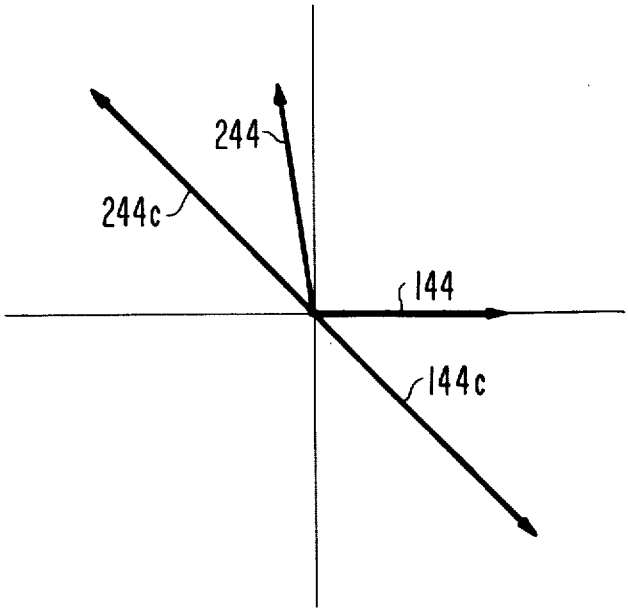
FIGS. 4A and 4B show phasor diagrams of excitations within the antenna.
Figure 4B:
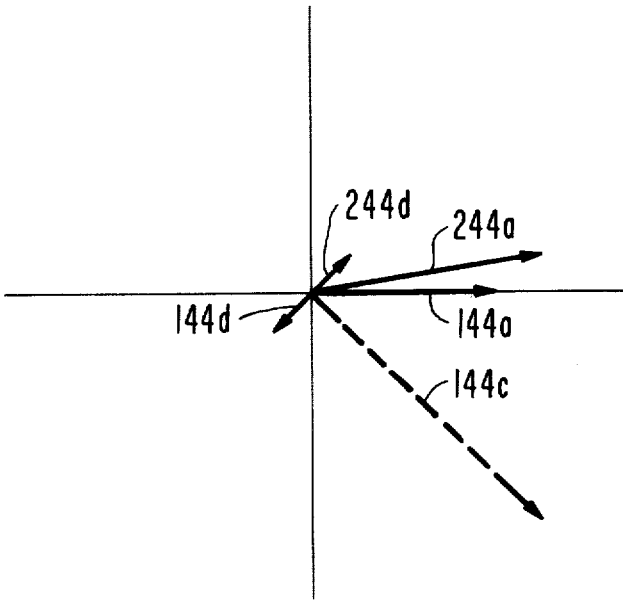

Consider now the TEM wave 40 as it is traveling from feed insulator 28 down the antenna. It first intersects the plus side and then the minus side of slot 44 directly causing it to radiate in a given phase, which will be the reference 0° phase for this and all further discussions. FIG. 4*a* shows this phase as phasor 144 which corresponds to the phase at the center of slot 44, i.e. along the center line 62. The wave 40 will then intersect the probe 44*c*. This probe in turn excites the slot 44. However, since probe 44*c* is spaced one eighth of a wavelength from the center 62 of slot 44, it is excited at a phase of minus 45° with respect to phasor 144. This is shown as phasor 144*c* in FIG. 4A. Phasor 144*c* represents the radiation from slot 44 resulting from excitation by probe 44*c*, and its amplitude may be adjusted relative to the direct excitation of slot 44 as represented by phasor 144 by adjustment of the depth of penetration of probe 44*c*. Still further, since the probe 44*c* is on the minus side of the slot, there is a further 180° phase inversion of the excitation of slot 44 by probe 44*c* with respect to the phasor 144*c*, which is shown as phasor 244*c*. The total radiation from the slot is the resultant of phasors 144, 244*c*, which is designated as 244 in FIG. 4A. This phasor has a phase of about 95° to 100° with respect to phasor 144. The wave 40 continues down the antenna where it intersects slot 44*a*. It is noted that it intersects the minus side of slot 44*a* first, so that there is 180° phase inversion occurring with respect to slot 44. However, slots 44 and 44*a* are spaced one half wavelength apart. This causes another 180° phase inversion. Thus the radiation from slot 44*a* caused by its being energized directly by wave 40 is in time phase with the radiation from slot 44 caused by its being energized directly from wave 40. This is shown in FIG. 4B by phasor 144*a* which has 0° phase shift, i.e. is oriented in the same direction, relative to phasor 144 of FIG. 4A. The amplitude of phasor 144*a* is slightly less than that of 144, since slot 44 has radiated some energy, thus reducing the energy in wave 40, thence reducing the amount of energy available for radiation by slot 44*a* due to direct excitation. For reference purposes, the phasor 144*c* from FIG. 4A is reproduced in dotted lines in FIG. 4B. In order to obtain an exact time phase difference of 90° between the energy radiated by slots 44 and 44*a*, as well as to obtain equal amplitudes of the radiated energy, the probe 44*d* is used. Since it is spaced from probe 44*c* by a quarter wavelength, its phasor has a 90° phase shift with respect to the phasor 144*c*, and has been labeled 144*d*. Further, since probe 44*d* is on the minus side of slot 44*a*, there is another phase shift of 180° resulting in the phasor 244*d*. The indirect excitation represented by phasor 244*d* adds to that of the direct slot excitation phasor 144*a*, which comes directly from wave 40, to provide the resultant phasor 244*a*. Probe 44*d* is adjusted so that phasor 244*a* is at an angle of 5 to 10 degrees, and, more exactly is in 90° phase relationship with respect to resultant phasor 244 of FIG. 4A. Thus it will be seen that slot pair 44, 44*a* are in the required time and space quadrature relationship to provide circularly polarized radiation.

All of the slots are identical except the slots comprising the top most bay and the bottom most bay. These slots are adjusted to provide a match of the spoke shorts 32 and 34 to the characteristic impedance of the antenna transmission line formed by outer conductor mast 10 and inner conductors 18 and 26. They therefore will radiate whatever energy is left at the top and the bottom of this transmission line respectively. Thus there will be no reflections from spoke shorts 32 and 34, and a pure traveling wave will be set up within the antenna transmission line.

The various slots cause an inductive mismatch to be present. Therefore probes 43, 45, 43*a*, and 45*a*, which cause a capacitive mismatch, are used to cancel the mismatch caused by the slots. Probes 43 and 43*a* are disposed between slots 42 and 44, and 42*a* and 44*a*, respectively, while probes 45 and 45*a* are disposed between slots 44 and 46, and 44*a* and 46*a*, respectively. They are placed half way between their respective slots so as not to excite them. They are substantially aligned on the horizontal center lines of the slots so that they can introduce equal and opposite mismatches as that presented by the slots at exactly the same place along the mast 10. The probe 44*c* also introduces a mismatch. If the mismatch caused by probe 44*c* were equal and opposite to that of probe 44*d*, then the two mismatches would cancel out, since there is quarter wave spacing between them. However, since the required excitation of slot 44 from probe 44*d* is smaller than that from probe 44*c*, probe 44*d* is much smaller than probe 44*c*, this mismatch cancellation effect will not take place. Therefore to compensate for the mismatches, compensating probe 70 is used so that it introduces reactance, which together with the reactance introduced by the probe 44*d* is equal and opposite to that produced by the probe 44*c*. Probe 70 is horizontally aligned with the probe 44*d* so that it introduces its reactance at the same point in the longitudinal direction of the antenna transmission line as that introduced by the probe 44*d*. Further, it is positioned half way between the slots 42*a*, 44*a* so as not to excite them. The above discussion is also applicable to the other probes 70, with respect to probes 42*d* and 44*d*.

Since the horizontal center to center spacing of a slot pair is one half of a wavelength, the vertically polarized components of the electric fields radiated by a pair of slots are out of phase along the antenna. This eliminates end fire radiation. The horizontal components go around mast 10, and thus do not cause end fire radiation.

Figures 5A, 5B, 5C:
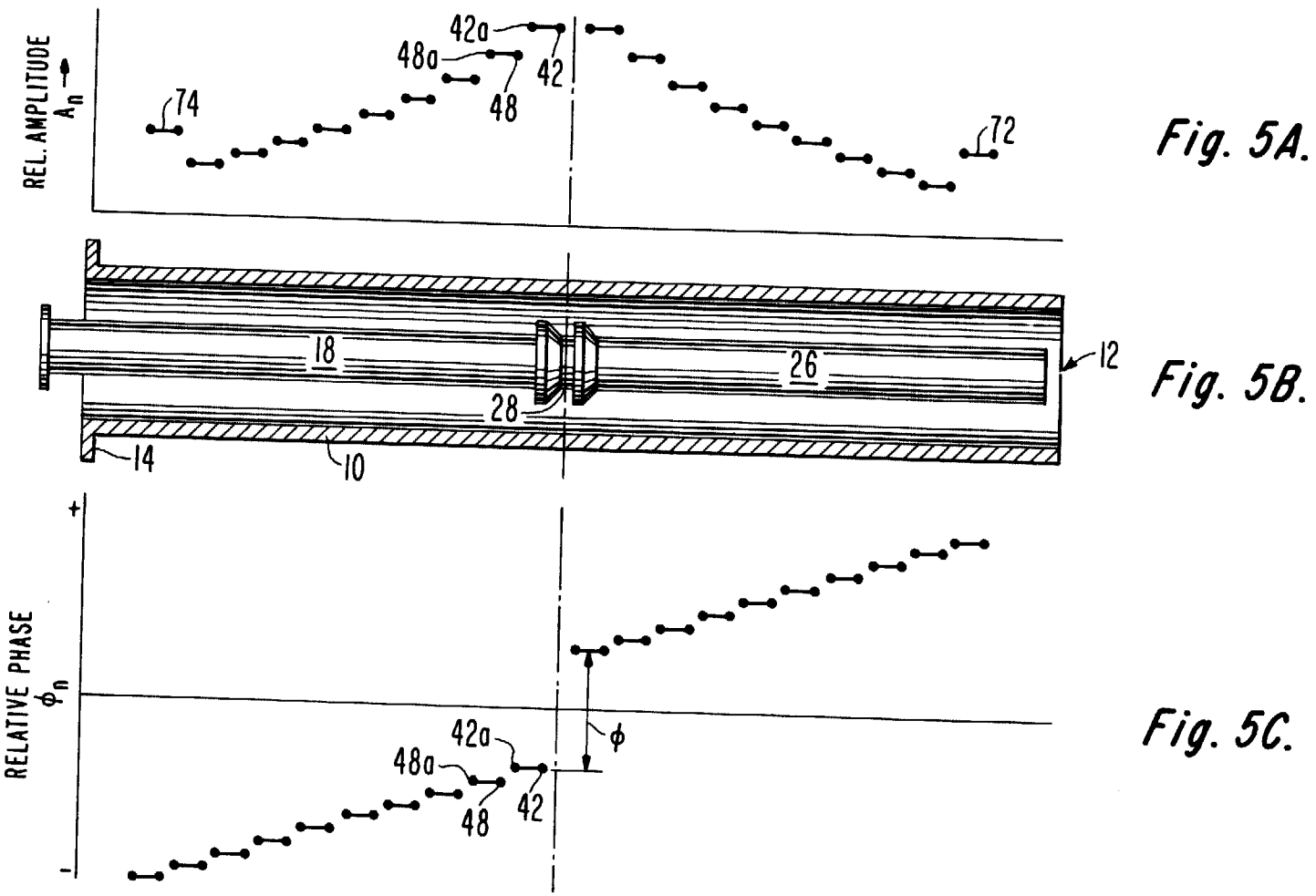
FIGS. 5A, 5B, 5C show phase and amplitude distributions of the energy radiated from slots in the antenna.

In an end fed traveling wave antenna, the beam tilt changes across a TV channel, the amount of change increasing with the length, i.e. the gain of the antenna. For relatively low gain antennas, this change is acceptable, whereas for medium and higher gain antennas, the beam tilt change can be as much as one-third of the beam width, which is unacceptable. Using centerfeed overcomes this problem and provides for improved impedance characteristic across a channel as well as improved impedance stability with respect to weather changes. However, centerfeed causes nulls in the elevation pattern at angles where it is undesirable to have them. FIG. 5 shows one way of overcoming this problem. FIG. 5B shows a simplified drawing of the antenna laid on its side for convenience. FIG. 5A shows a graph of the relative amplitude distribution of the radiation from one slot pair from each of the bays disposed along the length of the antenna. The other slot pairs in the same bay have the same relative amplitude radiation. It will be noted that the relative amplitudes decrease as one departs from the centerfeed point 28 of the antenna. The exception to this is the radiation from the slots in the top most bay 72 and the bottom most bay 74 which have greater relative amplitude than the preceding bays. This, as explained above, is to radiate all remaining energy at the top and bottom of the antenna transmission line. FIG. 5C shows a graph of the relative phase for the various slots in the bays versus distance along the antenna. In accordance with one aspect of the invention, a phase step $\phi$ is present at the center of the antenna at the feed point seal 28. This is accomplished by moving the feed point seal 28, i.e. the center of the inner conductors 18 and 26, slightly upwards (to the right in FIG. 5) keeping the mast 10 fixed and with all spacings between the slots remaining the same. It has been found that this phase step fills in the nulls caused by center feeding the antenna.

What is claimed is:

1. An antenna comprising a conducting vertical cylinder having a plurality of slots, said slots being disposed in a plurality of vertically stacked bays, each bay comprising at least one pair of slots disposed at about right angles to each other, slots of each pair being vertically spaced with respect to each other by about one half of a wavelength of a desired center frequency, said vertical spacing being established between horizontal centers of said slots, and means for exciting said slots so that slots comprising a pair are in about ninety degree time phase relationship and have about equal amplitudes with respect to each other.

2. An antenna as claimed in claim 1, wherein each bay comprises a plurality of pairs.

3. An antenna as claimed in claim 2, wherein said pairs of the same bay are spaced from each other by about 0.35 to 0.40 of said wavelength between vertical centers of said pairs, the number of said pairs being determined by a desired horizontal pattern and the diameter of said cylinder for a given frequency.

4. An antenna as claimed in claim 1, wherein said bays are stacked a distance of about one of said wavelengths.

5. An antenna as claimed in claim 1, wherein said exciting means comprises first probes disposed adjacent to at least one slot of each of said pairs of slots and extending into said cylinder.

6. An antenna as claimed in claim 5, wherein said exciting means further comprises second probes disposed adjacent to the remaining slot of each of said pairs of slots and extending into said cylinder, probes adjacent to each pair of slots being spaced by one quarter of said wavelength from each other and disposed on vertically opposite sides of a slot.

7. An antenna as claimed in claim 6, further comprising at least one impedance matching probe disposed on the inside of said cylinder between slots of different pairs, horizontally aligned with said second probes, and having a reactance that together with the reactance of said second probes is equal and opposite to the reactance of said first probes.

8. An antenna as claimed in claim 5, further comprising at least one impedance matching probe disposed on the inside of said cylinder between slots of different pairs and having a reactance that is equal and opposite to the reactance of the adjacent slots.

9. An antenna as claimed in claim 1, further comprising means for short circuiting the top and bottom of said cylinder, and wherein the topmost and bottommost bays of said slots have a characteristic impedance for matching the short circuiting means to that of the characteristic impedance of said antenna, whereby only a traveling wave can exist in the antenna.

10. An antenna as claimed in claim 9, further comprising means for providing a phase step between the bays in the upper and lower half of said antenna.

11. An antenna as claimed in claim 10, wherein said means for providing a phase step comprises an off center feed point.

* * * * *